US007210714B2

(12) United States Patent
Berghahn et al.

(10) Patent No.: US 7,210,714 B2
(45) Date of Patent: May 1, 2007

(54) LOCKING DEVICE FOR A MOVABLE CARBODY PART SUCH AS A REAR HATCH OF A VEHICLE

(75) Inventors: Jörg Berghahn, Gelsenkirchen (DE); Dirk Ruppach, Bochum (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 43 days.

(21) Appl. No.: 11/225,387

(22) Filed: Sep. 13, 2005

(65) Prior Publication Data

US 2006/0055181 A1 Mar. 16, 2006

(30) Foreign Application Priority Data

Sep. 14, 2004 (DE) ..... 10 2004 044 929

(51) Int. Cl.
*E05C 3/06* (2006.01)
*E05C 3/16* (2006.01)

(52) U.S. Cl. ..... 292/201; 292/216; 292/DIG. 23; 49/280

(58) Field of Classification Search ..... 292/201, 292/216, DIG. 23; 49/280
See application file for complete search history.

(56) References Cited

U.S. PATENT DOCUMENTS 3,695,662 A * 10/1972 Ploughman ..... 292/216
4,395,064 A * 7/1983 Bellot et al. ..... 292/201
4,815,775 A * 3/1989 Mertin et al. ..... 292/201
5,938,252 A * 8/1999 Uemura et al. ..... 292/201
6,341,448 B1 * 1/2002 Murray et al. ..... 49/280
6,659,515 B2 * 12/2003 Raymond et al. ..... 292/201

* cited by examiner

*Primary Examiner*—Brian Glessner
*Assistant Examiner*—Carlos Lugo
(74) *Attorney, Agent, or Firm*—Friedrich Kueffner

(57) ABSTRACT

A locking device for a movable carbody part has a lock and an interacting locking member. The lock has a rotary latch with pre-catch, main catch, and recess. When closing the carbody part, the locking member moves into the recess and rotates the rotary latch into a pre-catch position in which a pawl drops into the pre-catch. A motor-driven closing aid has a working lever and a control lever that are pivotably supported within the lock and have crossing slider block guides. The same slider block is guided in both slider block guides. When the working lever is pivoted by the motor of the closing aid, a shoulder of the slider block hits a counter shoulder of the rotary latch and rotates the rotary latch from the pre-catch position into a main catch position in which the pawl is supported on the main catch of the rotary latch.

10 Claims, 5 Drawing Sheets

LOCKING DEVICE FOR A MOVABLE CARBODY PART SUCH AS A REAR HATCH OF A VEHICLE

BACKGROUND OF THE INVENTION

1. Field of the Invention

The invention relates to a locking device for a movable carbody part such as a rear hatch of a vehicle. The locking device comprises a lock and a locking member interacting with the lock; one is mounted on the movable carbody part and the other is mounted on the stationary carbody. The lock has a rotary latch with a pre-catch, a main catch, and a recess. When closing the carbody part, the locking member moves into the recess of the rotary latch and the rotary latch is rotated to a pre-catch position in which a pawl, rotatably supported within the lock and spring-loaded, drops into the pre-catch of the rotary latch. A motor-driven closing aid for the movable carbody part is provided. It comprises two levers that are pivotably supported within the lock wherein the rotary latch is rotated by the motor by means of the levers into the main catch position, in which the pawl is supported on the main catch of the rotary latch. The lock thus comprises a rotary latch, a locking pawl, and a motor-driven closing aid with two levers that are stationarily and rotatably supported in the lock. The levers move the rotary latch from the pre-catch position, into which it has been moved upon closing of the movable carbody part by the locking member, into the main catch position that is secured by the pawl.

2. Description of the Related Art

A locking device of this kind has already been proposed; see German patent document 103 27 997. In this device, the closing aid comprises in addition to the stationarily supported levers two additional levers of which one is an elbow lever and the other serves as a driver for the rotary latch. These four levers are connected to one another by two additional swivel joints. The closing aid of this device requires many components and therefore also a large space within the lock.

SUMMARY OF THE INVENTION

It is an object of the present invention to develop a reliable locking device of the aforementioned kind that has only a few components and requires less space.

In accordance with the present invention, this is achieved in that the closing aid comprises an active working lever that is swivelled by the motor and comprises a slider block guide (working guide) in which a slider block is guided. The closing aid further comprises a passive control lever with a slider block guide (control guide) in which the same slider block that is guided in the working guide is also guided. The working guide crosses the control guide and the slider block is positioned at the crossing point of the two slider block guides. The slider block has a shoulder and the rotary latch has a counter shoulder. Upon motor-driven pivoting of the working lever, the shoulder hits the counter shoulder and causes the rotary latch to rotate from its pre-catch position into the main catch position.

Accordingly, the closing aid is comprised of a working lever that is swivelled by a motor by means of a connection connecting the motor and the working lever. A slider block is guided within the working lever. Moreover, the closing aid comprises a control lever with a control guide in which the same slider block as the one guided in the working lever is guided. Both slider block guides (working guide and control guide) cross one another and the slider block is positioned at all times at the crossing point of the two slider block guides. The slider block has moreover a shoulder that is correlated with a counter shoulder on the rotary latch. When the motor (not shown in detail) actuates the working lever, the shoulder of the slider block hits the counter shoulder of the rotary latch and rotates the rotary latch from its pre-catch position into the main catch position.

DESCRIPTION OF THE PREFERRED EMBODIMENTS

The locking device according to the present invention is comprised of a lock that, as already stated, is integrated into the rear hatch (not illustrated in detail) of a vehicle and also comprised of a locking member 14 in the form of a bracket that is attached to the stationary carbody of the vehicle. In the plan views of the drawings, not only the components of the lock arranged in the interior of a lock housing are illustrated but also the components of a closing aid cooperating with the lock. The locking member 14 is shown in section so that the cross bar of the bracket is illustrated in cross-hatching. The lock itself comprises the following components.

Figure 1:
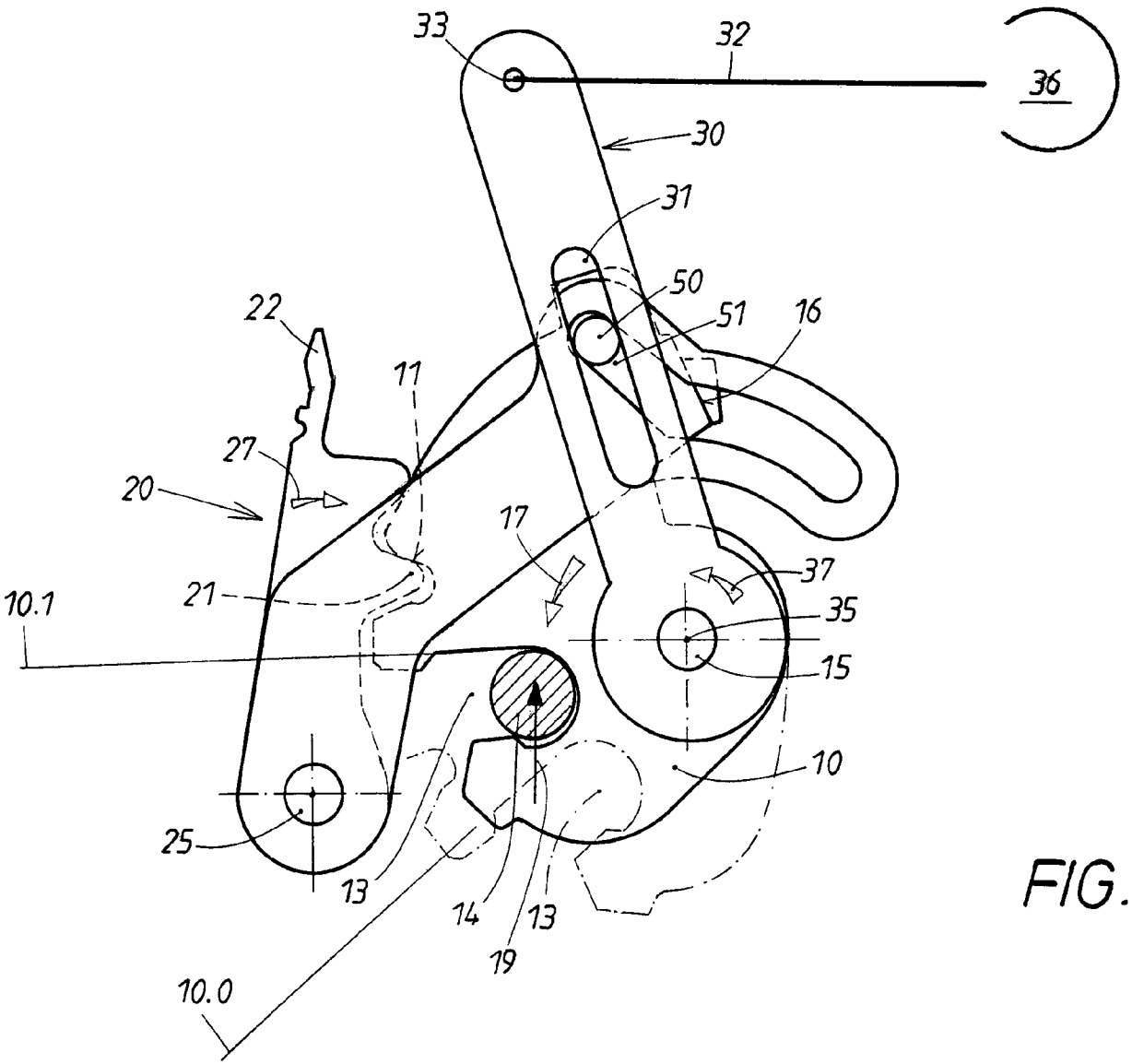
FIG. 1 shows a lock of the locking device of the present invention that is arranged on the rear hatch of a vehicle and is shown in a position that is reached after the hatch has been partially closed.

In the lock housing a rotary latch 10 is arranged on a stationary swivel axis 15. The rotary latch 10 comprises a pre-catch 11 illustrated in FIG. 1 and a main catch 12 that can be seen in FIG. 4. Moreover, the rotary latch 10 has a recess 13. When the hatch is open, the rotary latch 10, as illustrated in dash-dotted lines in FIG. 1, is in an open position illustrated by the auxiliary line 10.0. This open position 10.0 is determined by a stop and, in the illustrated embodiment, also determined by a spring load 17. When the hatch is closed by hand, the locking member 14 moves into the recess 13, indicated by the dash-dotted line in FIG. 1, and moves the rotary latch 10 from its position 10.0 shown in dash-dotted lines into the rotary position indicated by auxiliary line 10.1. Now the locking projection 21 of a pawl 20 can drop into the pre-catch 11 of the rotary latch 10. Accordingly, the rotary position 10.1 of FIG. 1 is the pre-catch position of the rotary latch 10.

The pawl 20 is mounted on a stationary swivel bearing 25 that is arranged, as already mentioned, within the lock housing (not illustrated) and is subjected to a spring load 27. The spring load 27 urges the pawl 20 against the rotary latch 10. When the pre-catch position 10.1 of the rotary latch 10 is reached, limit switches and/or sensors ensure that a motor 36, shown only schematically in FIG. 1, is turned on. The limit switches and/or sensors can also respond to the position of the rear hatch in the pre-catch position 10.1. The motor 36 initiates the movement of a closing aid that is of a very simple configuration and comprised only of the following components.

There is a working lever 30 that is connected by a connection 32 to the output member of the motor 36. This working lever 30 is mounted on a stationary swivel bearing 35 in the lock housing. In the illustrated embodiment, a swivel axis of the swivel bearing 35 is identical to the swivel or bearing axis 15 of the rotary latch 10. The connection 32 can be a rod or a cable of a Bowden cable device that engages the point of activation 33 of the working lever 30. The motor-driven working lever 30 is the active component of the closing aid. The working lever 30 has also a slider block guide 31, referred to in the following for short as working guide. The working guide 31 extends substantially radially to the swivel bearing 35 of the working lever 30. In the working guide 31, comprised of a linear slotted hole, a slider block 50 configured as a bolt is guided. In the drawings, the front end face of the slider block is shown. The rear of the slider block 50 has a shoulder 56 whose function will be explained in more detail in the following.

Figure 2:
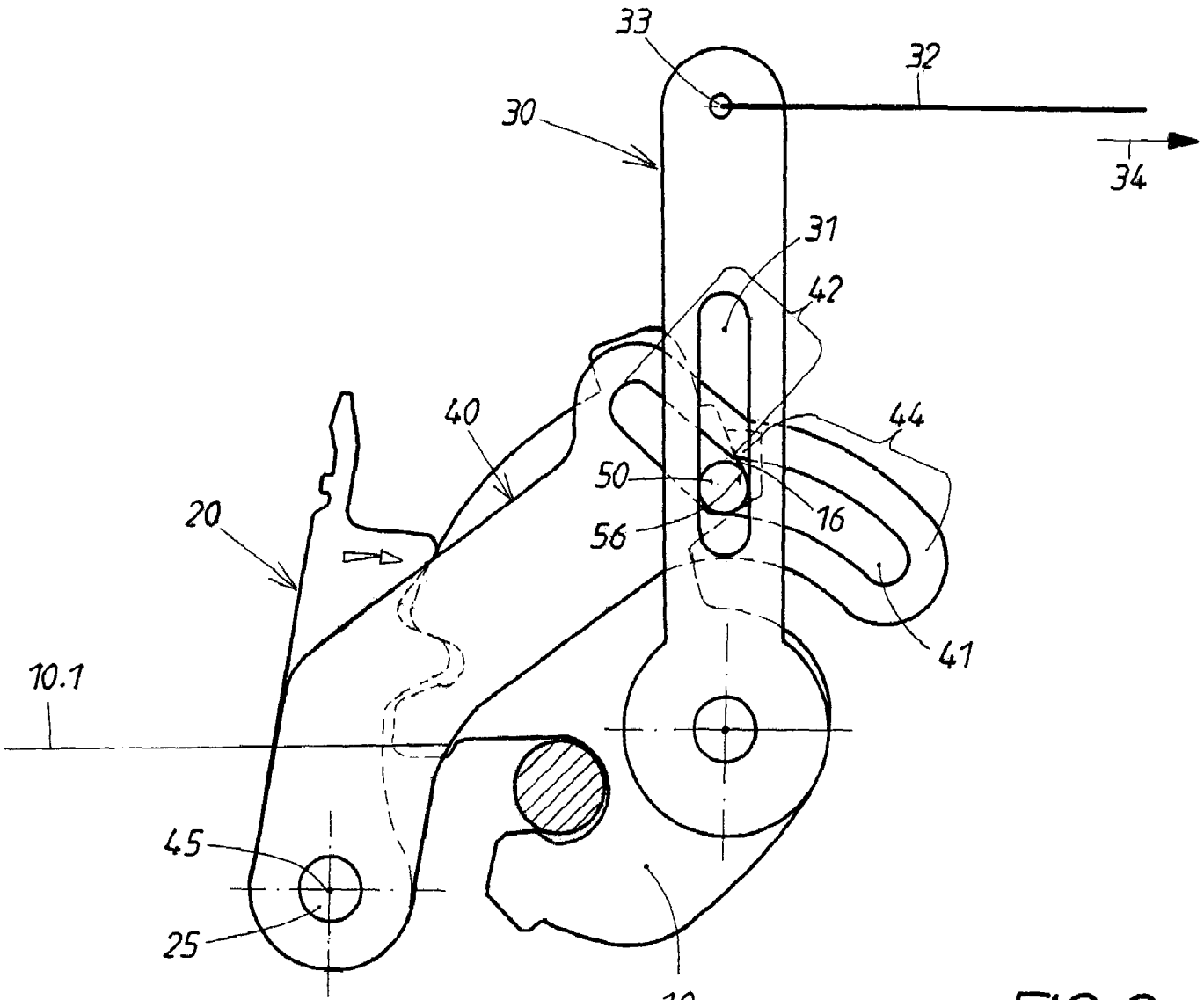
FIG. 2 shows the lock of FIG. 1 when the closing aid integrated into the lock is within a first phase of its movement.

The closing aid also comprises a control lever 40 that is supported on a stationary swivel bearing 45 in the lock housing. This swivel axis of the swivel bearing 45 is identical to the axis of rotation of the swivel bearing 25 of the pawl 20. The control lever 40 also has a slider block guide 41 which, for differentiating it from the aforementioned slider block guide 31, is referred to as control guide and can be seen best in FIG. 2. The control guide 41 extends at a slant relative to a radius that is positioned through the swivel axis 35 of the control lever 40. The control guide 41 can be divided into to guide sections 42 and 44 which differ in regard to their profiling or shape from one another. There is a substantially linear front section 42 that is substantially perpendicular to the aforementioned radius extending through the swivel axis 45 of the control lever 40. The terminal section 44 of the control guide 41, however, is arc-shaped. As shown in FIG. 2, this terminal section 44 has a circular shape. The center of the circle is positioned substantially on the swivel axis 35 of the neighboring working lever 30 whose swivel axis 35, as already mentioned, is identical to the axis of rotation 15 of the rotary latch 10. In the two sections 42, 44 of the control guide 41 the same slider block 50 as the slider block that engages the working guide 31 of the working lever 30 is guided. The two slider block guides 31, 41 cross one another. The slider block 50 is always positioned at the crossing point 51 of the working guide 31 and the control guide 41 that is shown best in FIG. 4.

For completing the closing aid, the rotary latch 10 must only be provided with a counter shoulder 16 that interacts with the aforementioned shoulder 56 of the slider block 50 in the way to be described in the following.

As already mentioned, the closing aid begins to operate when the pre-catch position 10.1 of FIG. 1 is reached when the hatch is closed. Now the working lever 30 is pivoted by the motor 36 in the direction of arrow 34 until it reaches the intermediate position illustrated in FIG. 2. In this intermediate position, the slider block 50 has moved within the working guide 31 as well as within the front section 42 of the control guide 41 to such an extent that the shoulder 56 of the slider block 50 comes to rest against the counter shoulder 16 of the rotary latch 10. From this moment on, a further actuation of the motor 36 in the direction of arrow 34 causes the working lever 30 to pivot farther into a pivoted position so that the lever 30 entrains in this way the rotary latch 10 by means of the shoulder 56 of the slider block 15 that is also being moved by the lever 30. Accordingly, the slider block 50 reaches the aforementioned circular arc-shaped terminal section 44 of the control guide 41 where it moves about the swivel axis 50 of the working lever 30 and thus also about the axis of rotation 15 of the rotary latch 10. As this occurs, the contacting areas of the pawl 20 are pivoted against the force of the spring load 27 acting on it out of the pre-catch 11 by suitable profilings.

Figure 3:
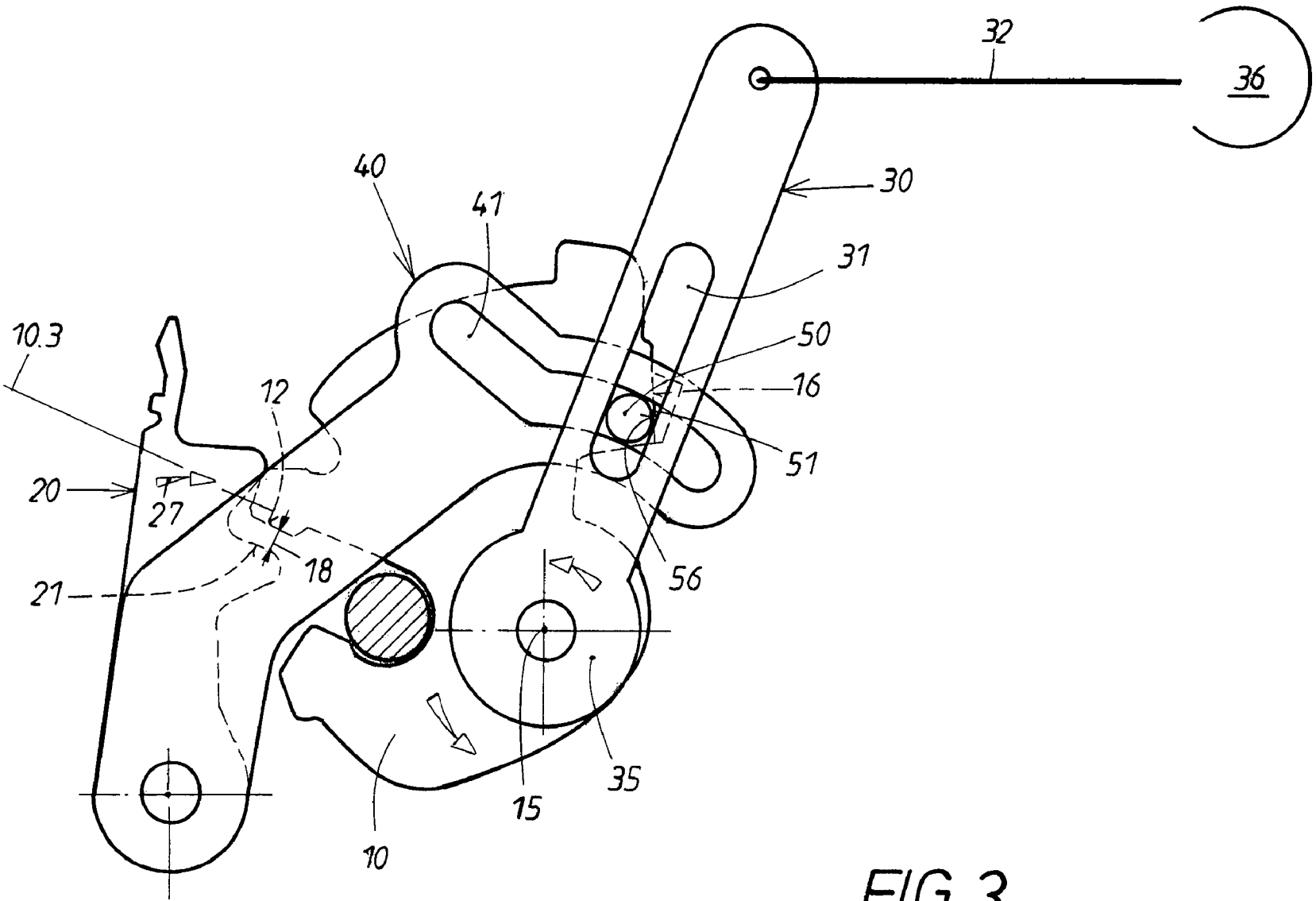
FIG. 3 shows the lock in a position where the closing aid presses the hatch especially tightly against the stationary carbody part.

The motor 36 will stop when the rotary position of the rotary latch 10, illustrated by the auxiliary line 10.3 in FIG. 3, is reached. In order for the locking projection 21 of the pawl 20 to drop safely into the main catch 12 as a result of its spring load, the rotary latch 10 has moved a little farther than necessary. In this way, a gap 18 shown in FIG. 3 is formed between the locking projection 21 of the pawl 20 and the main catch 12 of the rotary latch 10. Because of this gap 18, the aforementioned rotary position 10.3 is therefore referred to as the overextended position of the rotary latch 10.

Figure 4:
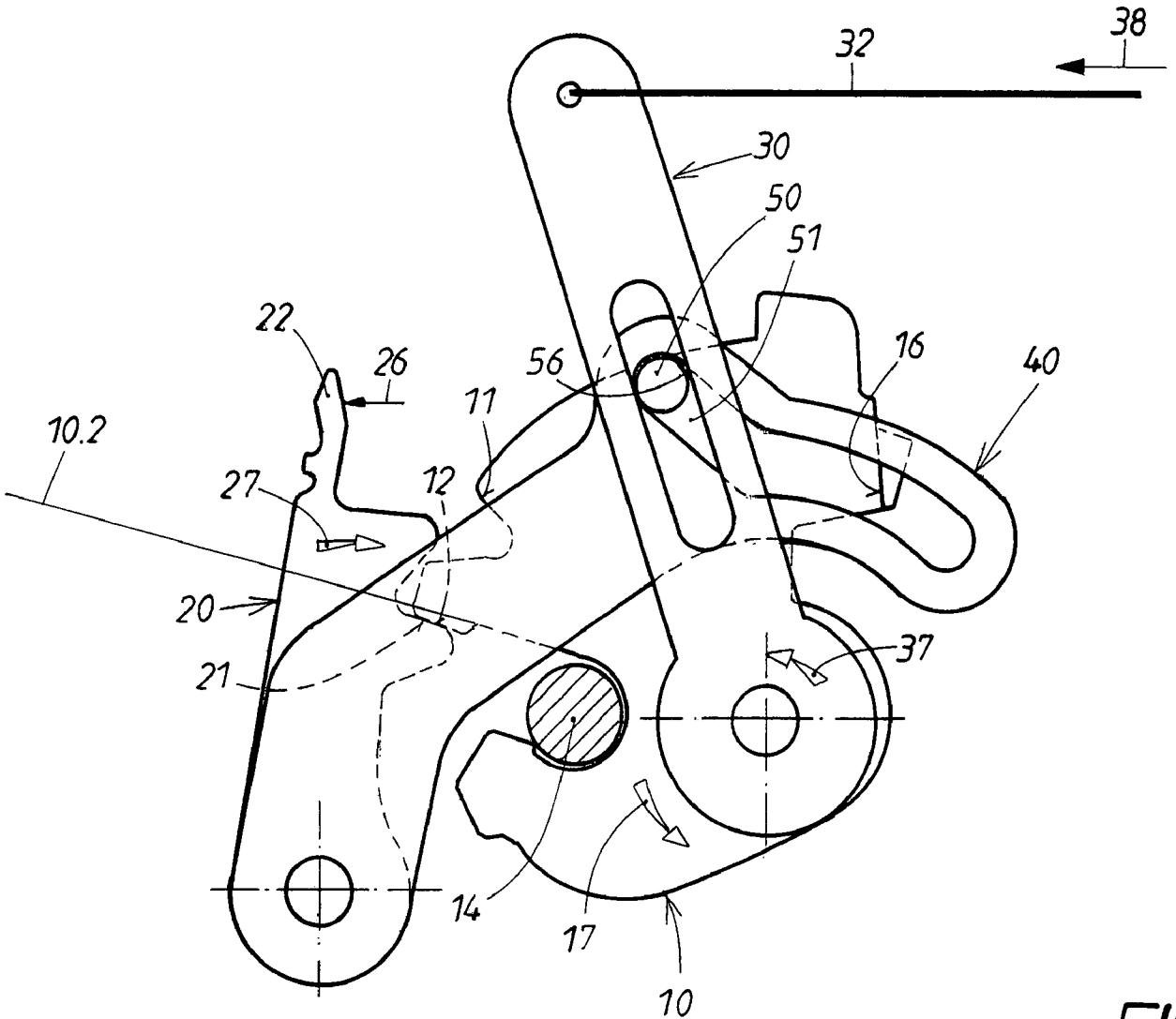
FIG. 4 shows the locking device after completion of the movement of the closing aid when the rear hatch is in its proper completely closed position.

The motor 36 can now release the aforementioned connection 32 to the working lever 30 so that the spring load 37 returns the working lever 30 into its initial position shown in FIG. 1. This process is illustrated in FIG. 4 by a return arrow 38. Alternatively, in the case of a fixed connection 32 to the working lever 30, the motor 36 can be used to return the working lever 30 into the aforementioned initial position of FIG. 1 or FIG. 4. The slider block 50 then has been moved, starting from FIG. 3, first in the terminal section 44 of the control guide 41 and subsequently also within the front section 42 of the control guide 41 as well as in the matching working guide 31 to the opposite end of the slider block guide. Immediately at the beginning of this return movement 38, the shoulder 56 of the slider block 50 has been lifted off the counter shoulder 16 of the rotary latch 10. In this way, the rotary latch 10 is rotated because of its spring load 17 to such an extent that its main catch 12 contacts the locking projection 21 of the pawl 20. The resulting position of the rotary latch 10 is illustrated by the auxiliary line 10.2 in FIG. 4; this position is therefore referred to as the main catch position of the rotary latch 10. As the rotary latch 10 passes from the pre-catch position 10.1 of FIG. 2 through the overextended position 10.3 into the main catch position 10.2, the locking member 14 is of course entrained by it. In the main catch position 10.2 of FIG. 4, the hatch is completely closed.

In order to be able to open the hatch, the pawl 20 has an actuation projection 22 for an opening device, not illustrated, which can be operated e.g. by a motor. By means of the opening device, the pawl 20 is rotated in the direction of arrow 26 of FIG. 4 and the locking projection 21 is thus moved away from the rotary latch 10. Accordingly, the main catch 12 and the pre-catch 11 are released. The rotary latch 10 can then be returned because of the spring load acting on it into the open position 10.0 of FIG. 1. Now the locking member 14 is also released and the rear hatch can be opened.

The motor-driven closing aid in the locking device of the present intention also makes it possible to open the hatch when the motor 36 or its electric control fails. This will be explained in more detail with the aid of FIG. 5.

Figure 5:
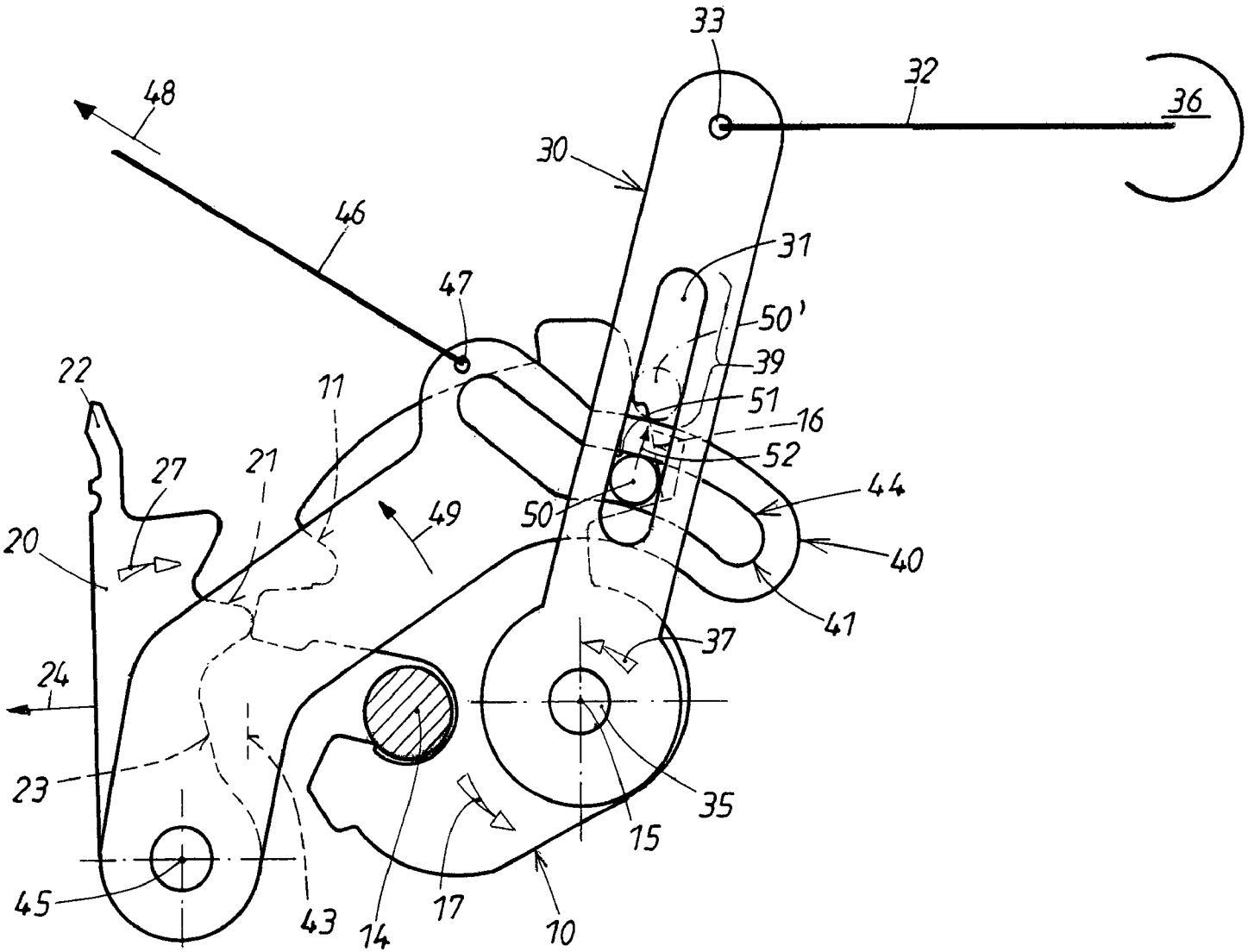
FIG. 5 shows the action of a manual emergency opening device integrated into the locking device for opening the lock when the motor or its electrical control has failed.

On the control lever 40 there is an engagement location 47 for an emergency actuation device of which in FIG. 5 only a connection 46 is illustrated. This emergency actuation or emergency opening device and the connection 46 can be manually actuated in the direction of arrow 48. The result of an actuation in the direction of arrow 48 is that the pawl 40 is moved against its spring load 27 in the direction of arrow 49 of FIG. 5. When pivoting in direction of arrow 49, the slider block 50 moves from the position illustrated in FIG.

5 into the end portion of the terminal section 44 of the control guide 41. As already disclosed, the terminal section 44 is a circular segment relative to the swivel axis 35 of the working lever 30 but not relative to the swivel axis 45 of the control lever 40. When pivoting in the direction of arrow 49, the slider block 50 reaches the end of the control guide end section 44. The slider block 50 is now positioned at a greater radial spacing relative to the swivel axis 45 of the control lever 40. Since the motor 36 according to the assumed scenario has failed, the working lever 30 remains initially in the position illustrated in FIG. 5 so that the position of the working guide 31 is stable. When pivoting the control lever 40 in the direction of arrow 49, the slider block 50 that is always positioned at the crossing point 51 of the two slider block guides 31, 41 is lifted in the direction of arrow 52 illustrated in FIG. 5 until the position 50' of the slider block 50 illustrated in dashed lines in FIG. 5 is reached; this position 50' is referred to as the emergency opening position. In this emergency opening position 50', the slider block 50 is located outside of the reach of the counter shoulder 16 of the rotary latch 10. Accordingly, upon emergency actuation (arrow 48) the rotary latch 10 is released and can be returned in the direction of its spring load 17 into the open position 10.0 of FIG. 1. The prerequisite for this is that the pawl 20 allows this to happen. This is achieved according to the present invention in the following way.

The control lever 40 has a control surface 43 that is aligned with a counter control surface 23 of the pawl 20. These control and counter control surfaces 43, 23 can be in the form of projections or crimped portions of these components 40, 20. Upon pivot movement (arrow 49) of the control lever 40 in the emergency situation, the control surface 43 hits the counter control surface 23 and moves the pawl 20 against the spring load 27 in the direction of the already mentioned arrow 24 away from the rotary latch 10. When the rotation (arrow 24) has moved the locking projection 21 out of engagement, the locking projection 21 can no longer drop into one of the catches, for example, into the pre-catch 11, of the rotary latch 10 when the rotary latch 10 is returned by its own spring load 17 into the pre-catch position 10.1 of FIG. 1. The hatch is thus open and access to the interior of the vehicle is possible.

While specific embodiments of the invention have been shown and described in detail to illustrate the inventive principles, it will be understood that the invention may be embodied otherwise without departing from such principles.

What is claimed is:

1. A locking device for a movable carbody part of a vehicle, the locking device comprising:

a lock and a locking member interacting with the lock, wherein one of the lock and the locking member is mounted on the movable carbody part and the other of the lock and the locking member is mounted on the stationary carbody;

the lock having a rotary latch with a pre-catch, a main catch, and a recess;

the lock comprising a pawl that is rotatably supported within the lock and is spring-loaded;

wherein, when closing the moveable carbody part, the locking member moves into the recess of the rotary latch and the rotary latch is rotated by the locking member from an open position into a pre-catch position and the pawl drops into the pre-catch of the rotary latch in the pre-catch position of the rotary latch;

a closing aid acting on the movable carbody part and comprising a drive motor;

the closing aid comprising an active working lever and a passive control lever connected to the working lever, wherein the working lever and the control lever are pivotably supported within the lock;

the working lever comprising a working guide and a slider block guided in the working guide;

the control lever having a control guide in which the slider block of the working lever is guided, wherein the working guide crosses the control guide and the slider block is positioned at a crossing point of the working guide and the control guide;

the slider block having a shoulder and the rotary latch having a counter shoulder;

wherein, when the working lever is pivoted by the motor from an initial position into a pivoted position, the shoulder of the slider block hits the counter shoulder of the rotary latch and causes the rotary latch to rotate from the pre-catch position into a main catch position, wherein the pawl in the main catch potion of the rotary latch is supported on the main catch of the rotary latch.

2. The locking device according to claim 1, wherein the working lever has a stationary swivel bearing having a swivel axis that coincides with an axis of rotation of the rotary latch.

3. The locking device according to claim 1, wherein the control lever has a stationary swivel bearing having a swivel axis that coincides with an axis of rotation of the pawl.

4. The locking device according to claim 1, further comprising a manual emergency opening device for opening the locking device when the motor fails, wherein the manual emergency opening device engages the control lever and upon actuation pivots the control lever until the slider block reaches a release position in which release position the counter shoulder is released, wherein the control lever has a control surface and the pawl has a counter control surface, wherein upon actuation of the manual emergency opening device the control surface hits on the counter control surface and the pawl is rotated away from the rotary latch and the rotary latch is returned by a spring load into the open position and releases the locking member.

5. The locking device according to claim 1, wherein the working guide extends substantially radially relative to a swivel axis of the working lever.

6. The locking device according to claim 1, wherein the control guide extends at a slant relative to a radius extending through a swivel axis of the control lever.

7. The locking device according to claim 6, wherein the control guide of the control lever is comprised of several guide sections having different profilings.

8. The locking device according to claim 7, wherein the several guide sections comprise a substantially linear front section and an arc-shaped terminal section, wherein the slider block is located within the front section when the rotary latch is positioned in the open position up to the pre-catch position and wherein the slider block moves into the terminal section when the rotary latch moves into the main catch position.

9. The locking device according to claim 8, wherein the terminal section has substantially a circular shape and wherein the circle of the circular shape extends substantially coaxially to a swivel axis of the working lever.

10. The locking device according to claim 8, wherein the front section extends substantially perpendicularly to the radius extending through the swivel axis of the control lever.

* * * * *